US005135117A

United States Patent [19]

Geis

[11] Patent Number: 5,135,117

[45] Date of Patent: Aug. 4, 1992

[54] COMBINATION RAILWAY CAR DRAFT GEAR STOP AND BOLSTER SPACER PLATE APPARATUS

[75] Inventor: Charles A. Geis, Finleyville, Pa.

[73] Assignee: McConway & Torley Corporation, Pittsburgh, Pa.

[21] Appl. No.: 684,571

[22] Filed: Apr. 12, 1991

[51] Int. Cl.[5] ..... B61G 7/10

[52] U.S. Cl. ..... 213/57; 213/56; 105/199.4

[58] Field of Search ..... 213/50, 56 X, 57, 64; 105/199.4 X, 228, 420

[56] References Cited

U.S. PATENT DOCUMENTS

| | | | |
|---|---|---|---|
| 1,361,087 | 12/1920 | Murray | 213/56 |
| 1,458,792 | 6/1923 | Wright | 213/57 |
| 2,781,919 | 2/1957 | Blattner | 105/420 X |
| 3,703,239 | 11/1972 | Furniss | 213/57 |
| 4,252,068 | 2/1981 | Nolan | 105/199.4 X |

OTHER PUBLICATIONS

Engineering Drawing (Labelled Sketch 1), pre Apr. 1991.

Engineering Drawings (Labeled Sketch 2), pre Apr. 1991.

Engineering Drawing (Labeled Sketch 3), pre Apr. 1991.

1970 edition of "Car and Locomotive Cyclopedia" published by Simmons-Boardman pp. 568-570.

*Primary Examiner*—Robert J. Oberleitner
*Assistant Examiner*—S. Joseph Morano
*Attorney, Agent, or Firm*—James Ray & Associates

[57] ABSTRACT

The present invention provides a combination rear draft stop and bolster spacer plate apparatus which includes a rear wall portion, a pair of side wall portions connected along a rear edge thereof to a respective outer edge of the rear wall portion. There is top wall portion formed adjacent the upper edge of each of the rear wall portion and the pair of side wall portions. A first cavity is formed through the top wall portion. A bottom wall portion is formed adjacent a bottom edge of each rear wall portion and the pair of side wall portions. A second cavity is formed through this bottom wall portion. The final essential element is a pair of front wall portions which have an outer surface thereof engageable by a draft gear to limit rearward movement of such draft gear when a buff load is exerted thereon.

20 Claims, 3 Drawing Sheets

COMBINATION RAILWAY CAR DRAFT GEAR STOP AND BOLSTER SPACER PLATE APPARATUS

FIELD OF THE INVENTION

The present invention relates, in general, to rear draft stops and bolster spacer plate members mounted in a predetermined location of a generally hollow center sill member disposed on a railway car and, more particularly, the present invention relates to an improvement in such combination railway car rear draft stop and bolster spacer plate members which enables it to be cast as an integral single piece unit for mounting within such hollow center sill of the railway car.

BACKGROUND OF THE INVENTION

Prior to the present invention, in the railway industry, rear draft stops and bolster spacer plates have been used for a number of years. See, for example, Pages 568 and 570 of the 1970 edition of "Car and Locomotive Cyclopedia"published by Simmons-Boardman Publishing Corporation. Reference to these pages being incorporated herein by reference thereto.

These prior art draft gear stops and bolster spacer plates have been manufactured from as many as nine individual components which requires a considerable amount of welding. Obviously, such welding is expensive and can even induce premature failure of such gear draft stop and bolster spacer plate. Such failure can result, for example, from stress cracks on excessive porosity being present in the weld metal.

It is also known in the prior art, to produce the rear draft stop and bolster spacer plate members from two substantially identical pieces. In this case, the two pieces are welded together adjacent the mating surfaces to form the final rear draft stop and bolster spacer plate apparatus.

In either of the cases discussed above, welding jigs are required to maintain necessary tolerances during the fabrication process. This practice obviously adds significantly to the manufacturing cost as well as the installation cost.

As shown in the above identified reference, the rear draft stop and bolster spacer plate member can be mounted within a hollow center sill of a railway car by any number of means, such as, bolting, riveting or welding.

Further, the prior art rear draft stop and bolster spacer plate equipment discussed above is relatively heavy thereby increasing the weight of the car and the difficulty in handling the component parts.

From the above discussion, it can be seen that a need exists in the railroad industry for an improved combination rear draft stop and bolster spacer plate apparatus.

SUMMARY OF THE INVENTION

The present invention provides an improved combination railway car rear draft stop and bolster spacer plate apparatus. This apparatus can be cast as an integral single piece unit thereby simplifying mounting of the apparatus within a generally hollow center sill member of such railway car. The combination rear draft stop and bolster spacer plate apparatus includes a generally rectangular rear wall portion which has a first predetermined width and a first predetermined height and a first predetermined thickness. A pair of generally rectangular side wall portions having a first predetermined configuration and a second predetermined width and a second predetermined height are provided. A rear edge portion of each of such pair of side wall portions is joined with a respective outer edge portion of such rear wall portion along the first predetermined height of the rear wall portion and the second predetermined height of such rear edge portion of such each of such pair of side wall portions. The apparatus also includes a generally rectangular top wall portion formed adjacent an upper edge portion of each of such rear wall portion and such each of the pair of side wall portions. The top wall portion has a first predetermined length and a third predetermined width and a second predetermined thickness. A first cavity is formed through the top wall portion. This first cavity has a second predetermined configuration. Further, such first cavity starts adjacent a front outer edge of the top wall portion and extends rearwardly therefrom toward such rear wall portion for a first predetermined distance. Also provided, in this apparatus, is a generally rectangular bottom wall portion which is formed adjacent a bottom edge portion of such rear wall portion and each of such pair of side wall portions. This bottom wall portion has a second predetermined length and a fourth predetermined width and a third predetermined thickness. A second cavity is formed through this bottom wall portion. Such second cavity has a third predetermined configuration. Also, the second cavity starts adjacent the front outer edge of such bottom wall portion and extends in a rearward direction toward such rear wall portion for a second predetermined distance. The rear draft stop and bolster spacer plate apparatus also includes a pair of generally rectangular front wall portions. An outer surface of each of such front wall portions is engageable with a draft gear. Such front wall portions are provided to limit rearward movement of such draft gear during a buff load being exerted on the draft gear. Each of such front wall portions extend inwardly from an inner surface of a respective side wall portion for a third predetermined distance and between a bottom surface of such top wall portion and an upper surface of such bottom wall portion.

OBJECTS OF THE INVENTION

It is, therefore, one of the primary objects of the present invention to provide an improved combination railway car rear draft stop and bolster spacer plate apparatus which can be cast as an integral single piece unit.

Another object of the present invention is to provide an improved combination railway car rear draft stop and bolster spacer plate apparatus which does not require any welding jigs for installation in a hollow center sill of a railway car.

Still another object of the present invention is to provide an improved combination railway car rear draft stop and bolster spacer plate apparatus which requires no welding to produce.

Yet another object of the present invention is to provide an improved combination railway car rear draft stop and bolster spacer plate apparatus which will provide increased lug face reinforcement when compared to prior art devices.

A further object of the present invention is to provide an improved combination railway car rear draft stop and bolster spacer plate apparatus which is significantly lighter in weight than prior art devices.

An additional object of the present invention is to provide an improved combination railway car rear draft stop and bolster spacer plate apparatus which meets or exceeds the minimum load requirements of the Association of American Railroads (AAR).

Still yet another additional object of the present invention is to provide an improved combination railway car rear draft stop and bolster spacer plate apparatus which is relatively inexpensive to manufacture.

Yet still another object of the present invention is to provide an improved combination railway car rear draft stop and bolster spacer plate apparatus which requires a minimum of maintenance during it's useful life.

In addition to the numerous objects and advantages of the improved combination railway car rear draft stop and bolster spacer plate apparatus described above, various other objects and advantages of the present invention will become more readily apparent to those persons who are skilled in the art from the following, more detailed, description of the invention, particularly, when such description is taken in conjunction with the attached drawings and with the appended claims.

BRIEF DESCRIPTION OF THE VARIOUS EMBODIMENTS OF THE INVENTION

Figure 1:
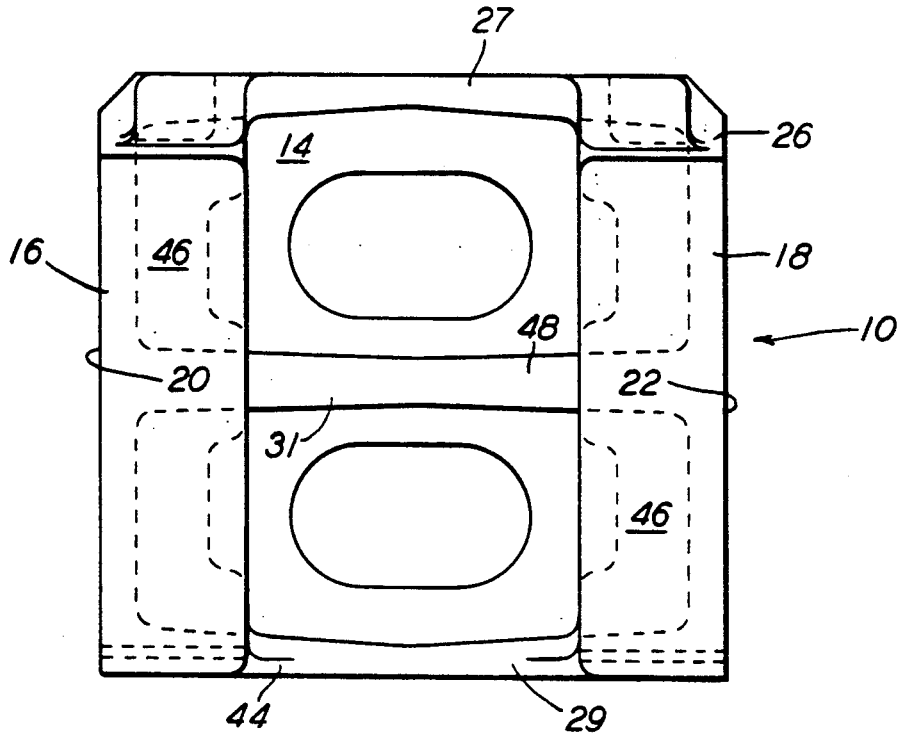
FIG. 1 is a front elevation view of a presently preferred embodiment of the improved combination railway car rear draft stop and bolster spacer plate apparatus.
Figure 2:
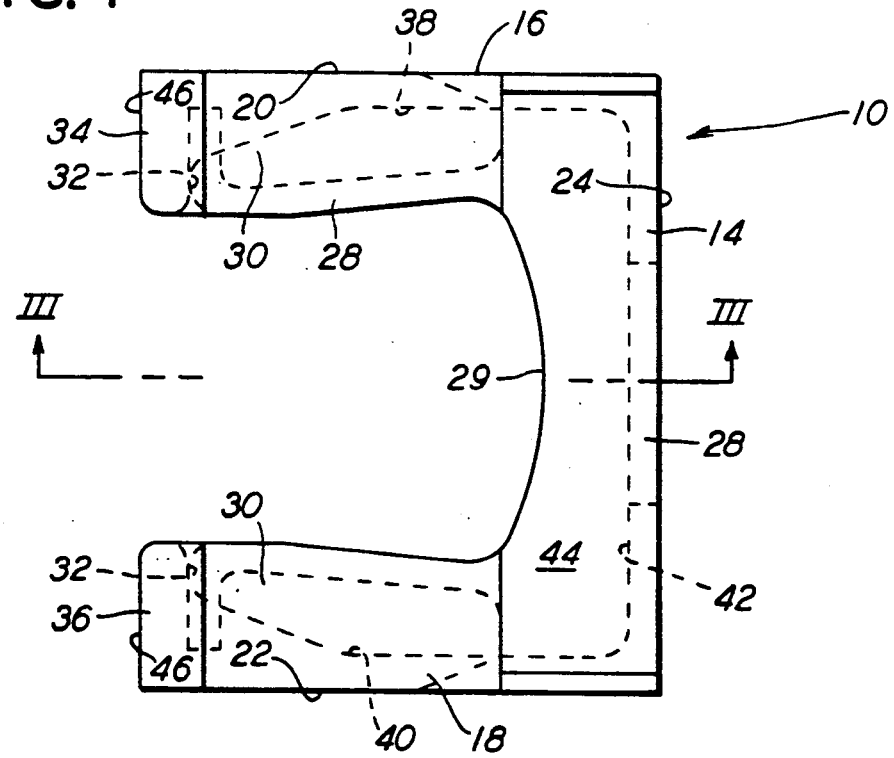
FIG. 2 is a bottom view of the improved combination railway car rear draft stop and bolster spacer plate apparatus illustrated in FIG. 1.
Figure 3:
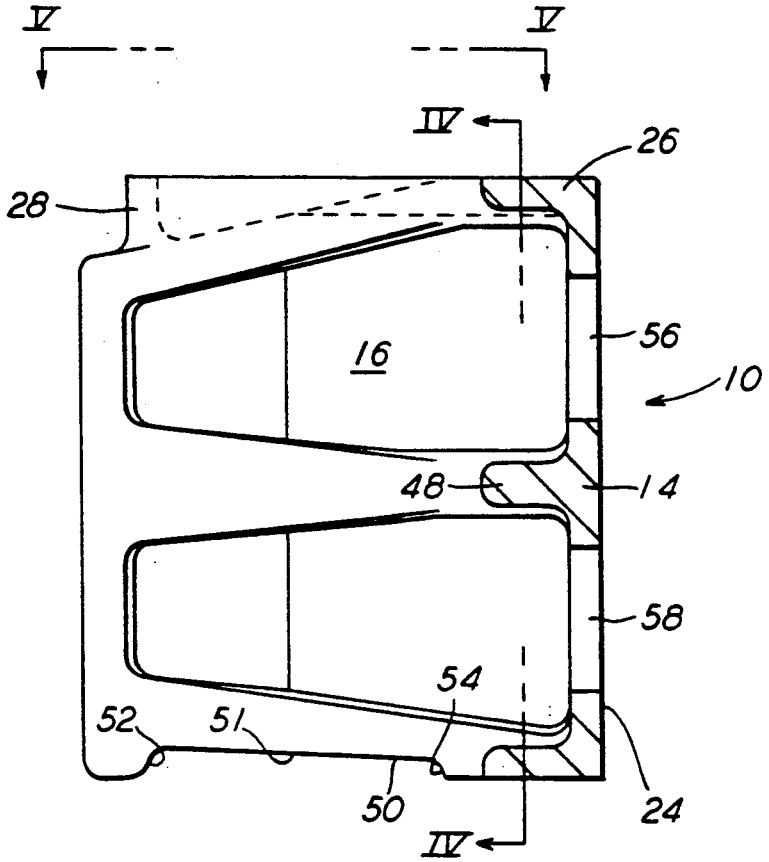
FIG. 3 is a side elevation view, partially in cross section, taken along the lines III—III of FIG. 2.
Figure 4:
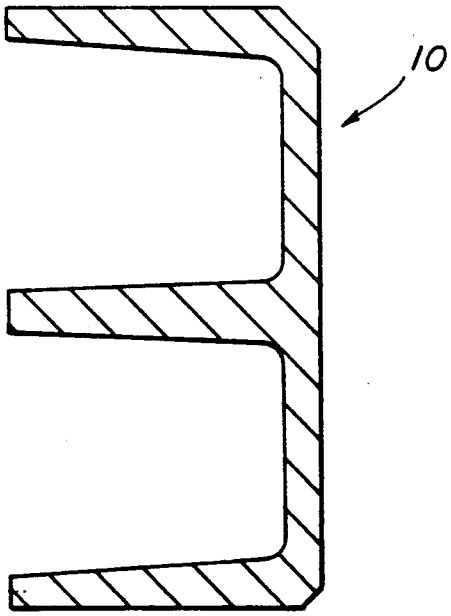
FIG. 4 is a cross-sectional view taken along the lines IV—IV of FIG. 3.
Figure 5:
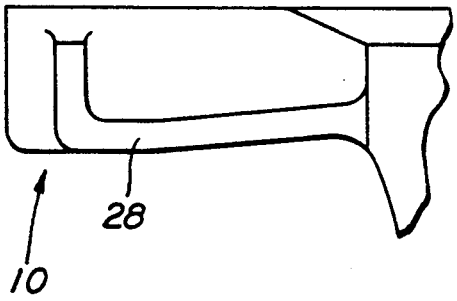
FIG. 5 is a fragmented top elevation view showing a preferred embodiment of a rib portion disposed on a top wall portion of the apparatus.

Prior to proceeding to the more detailed description of the combination rear draft stop and bolster spacer plate apparatus, it should be noted that through the several views illustrated in the drawings, identical components having identical functions have been identified with identical reference numerals for the sake of clarity.

Figure 6:
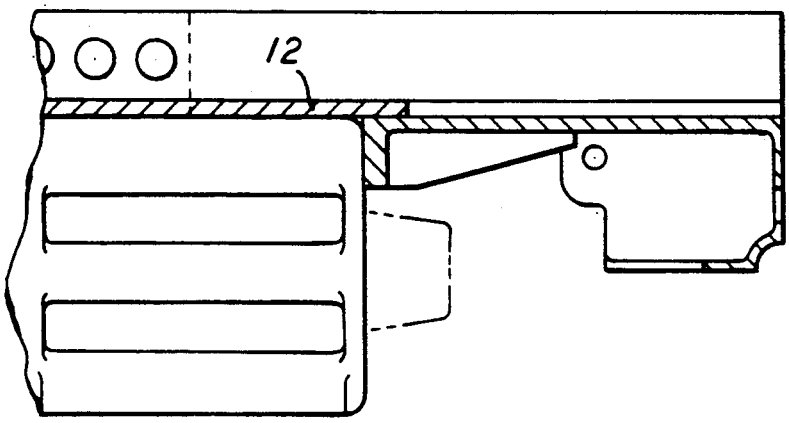
FIG. 6 PRIOR ART
FIG. 6 is a fragmented top elevation view, partially in cross section, showing a portion of a prior art rear draft stop mounted in a generally hollow center sill member.
Figure 7:
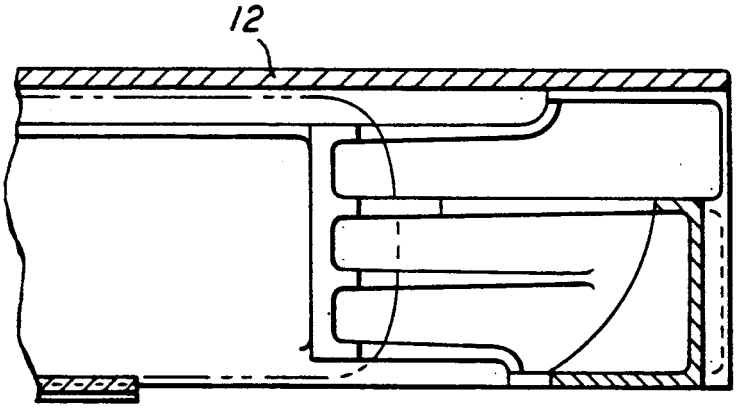
FIG. 7 PRIOR ART
FIG. 7 is a fragmented side elevation view, partially in cross section, showing a prior art rear draft stop mounted in a generally hollow center sill member.

Now refer, more particularly, to FIGS. 1 through 5. Illustrated therein is an improved railway car combination rear draft gear stop and bolster spacer plate apparatus, generally designated 10. Such apparatus 10 is designed so that it can be cast as an integral single piece unit. The casting of apparatus 10 as a single piece unit not only facilitates the mounting thereof within a generally hollow center sill member (FIGS. 6 and 7) disposed beneath the floor of a railway car (not shown), but it also enables a reduction in manufacturing cost to be achieved at the same time.

The combination rear draft stop and bolster spacer plate apparatus 10 includes a rear wall portion 14 that is generally rectangular in shape. Rear wall portion 14 has a first predetermined width and a first predetermined height and a first predetermined thickness. In the presently preferred embodiment of the invention, the first predetermined width of such rear wall portion 14 will generally be between about 12.81 inches and about 12.87 inches. Further, the first predetermined thickness of such rear wall portion 14 will preferably be in a range of between about 0.615 inch and about 0.645 inch. The first predetermined height of the rear wall portion 14 including the height of a rib-like portion 28 which extends above an outer surface of a top edge portion of such rear wall portion 14 will! preferably be between about 12.18 inches and about 12.30 inches.

The apparatus 10 also includes a pair of side wall portions 16 and 18 which are also generally rectangular in shape. Each or the side wall portions 16 and 18 having a first predetermined configuration and a second predetermined width and a second predetermined height. In the presently preferred embodiment of the invention, such second predetermined width of each of the pair of side wall portions 16 and 18 will be generally between about 10.63 inches and about 10.72 inches. Also, in this embodiment, the second predetermined height will be substantially equal to the first predetermined height of the rear wall portion 14. A rear edge portion of each of the pair of side wall portions 16 and 18 is joined with a respective outer edge portion of such rear wall portion 14 along such first predetermined height of the rear wall portion 14 and the second predetermined height of the rear edge portion of each of the pair of side wall portions 16 and 18. An outer surface 20 and 22 of each of the pair of side wall portions 16 and 18, respectively, is disposed substantially at right angles to an outer surface 24 of the rear wall portion 14.

In this presently preferred embodiment of the invention, such first predetermined configuration of each of the pair of side wall portions 16 and 18 includes a thickened wall section 30 which extends from an inner surface 32 of a respective one of a pair of front wall portions 34 and 36. The thickened wall portion 30 merges smoothly into the inner surface 38 and 40 at a predetermined location on a respective one of such pair of side wall portions 16 and 18. In the most preferred embodiment of the invention, such thickened wall section 30 will be generally triangular in shape. Such triangular shaped thickened wall section 30 providing the requisite amount of reinforcement required during a buff load being exerted on the draft gear during operation of a train consist.

The combination rear draft stop and bolster spacer plate apparatus 10 further has a top wall portion 26 which is generally rectangular in shape. The top wall portion 26 s formed adjacent an upper edge portion of each of the rear wall portion 14 and each of such pair of side wall portions 16 and 18. The top wall portion 26 has a first predetermined length and a third predetermined width and a second predetermined thickness. The first predetermined length of the wall portion 26 is substantially equal to the predetermined width of the pair of side wall portions 16 and 18 and the third predetermined width of such top wall portion 26 is substantially equal to the first predetermined width of the rear wall portion 14.

A first cavity 27 is formed through such top wall portion 26. Such first cavity has a second predetermined configuration which preferably is bulb shaped. This first cavity starts adjacent a front outer edge of the top wall portion 26 and extends rearwardly therefrom and toward an inner surface 42 of the rear wall portion 14 for a first predetermined distance which, at a maximum point, is preferably between about 8.235 inches and about 8.265 inches.

The apparatus 10 also has a generally rectangular shaped bottom wall portion 44 formed adjacent a bottom edge portion of the rear wall portion 14 and each of the pair of side wall portions 16 and 18. Such bottom wall portion 44 has a second predetermined length which is substantially equal to the first predetermined length of the top wall portion 26 and a fourth predetermined width which is substantially equal to the first predetermined width of such rear wall portion 14. The bottom wall portion 44 has a third predetermined thickness.

A second cavity 29, is formed through such bottom wall portion 44 and has a third predetermined configuration which, in the presently preferred embodiment of the invention, is substantially identical to the second predetermined configuration of the first cavity formed through the top wall portion 26. Such second cavity starts adjacent a front outer edge of such bottom wall portion 44 and extends rearwardly therefrom toward the inner surface 42 of such rear wall portion 14 for a second predetermined distance which, in the presently preferred embodiment, is substantially equal to the first predetermined distance of the first cavity formed through such top wall portion 26.

A final essential element of the apparatus 10 is a pair of generally rectangular shaped front wall portions 34 and 36 which have a substantially flat outer surface 46. The outer surface 46 of each of the front wall portions 34 and 36 is engageable by at least a portion of a rear surface of a back wall of a draft gear (not shown). Such front wall portions 34 and 36 limit the rearward movement of such draft car during a buff load being exerted thereon. Each of such front wall portions 34 and 36 extend inwardly from an inner surface 38 and 40 of a respective side wall portion 16 and 18 for a third predetermined distance and between a bottom surface of the top wall portion 14 and an upper surface of the bottom wall portion 44.

In a more preferred embodiment of the invention, the apparatus 10 further includes another wall portion 48 which has a third predetermined length and a fifth predetermined width. Such wall portion 48 is disposed intermediate the bottom surface of such top wall portion 26 and the upper surface of such bottom wall portion 44. This wall portion 48 includes a third cavity 31 formed therethrough which has a fourth predetermined configuration that is substantially identical to the second predetermined configuration of the first cavity and the third predetermined configuration of the second cavity. Such third cavity starts adjacent a front outer edge of such wall portion 44 and extends rearwardly therefrom toward the inner surface 42 of the rear wall portion 14 for a third predetermined distance that is substantially equal to the first and second predetermined distance of such first cavity and second cavity respectively.

Also, in a more preferred embodiment of the apparatus 10, there is a rib-like portion 28 which has a fifth predetermined configuration. Such rib-like portion 28 extends above an outer surface of a top edge portion of each of the rear wall portion 14 and such pair of side wall portions 16 and 18. A primary function of the rib-like portion 28 is to provide a welding surface to assist in securing the apparatus 10 within such hollow center sill member of such railway car.

Further, the apparatus 10 includes a groove-like portion 50 formed in a bottom surface of such bottom wall portion 44. The groove-like portion 50 extends from the outer surface 20 of the first side wall portion 16 to the outer surface 22 of the second side wall portion 18. One edge 52 of the groove-like portion 50 is disposed behind a vertical plane extending along an inner surface 32 of such pair of front wall portions 34 and 36 and a second axially opposed edge 54 of such groove-like portion 50 is disposed in front of vertical plane extending along the inner surface 42 of the rear wall portion 14. Such groove-like portion 50 includes a tapered upper wall surface 51.

It is also presently preferred that the rear wall portion 14 will include at least one aperture 56 formed therethrough. Such at least one aperture 56 provides a means for reducing the weight of such apparatus 10. It is even more preferred that such rear wall portion !4 will include at least two apertures 56 and 58 formed therethrough in order to provide a maximum reduction in weight of such apparatus 10. A first of such apertures 56 and 58 is disposed between the top wall portion 26 and such other wall portion 48 and the second of such apertures 56 and 58 is disposed between such bottom wall portion 44 and the wall portion 48 of the apparatus 10. It is presently preferred that each of the apertures 56 and 58 will have a length dimension which is greater than a width dimension thereof. In this embodiment, it is also preferred that each end of such apertures 56 and 58 will have a generally rounded shape.

In the presently most preferred embodiment, the fourth predetermined configuration of such wall portion 48 will include a thickness of between about 2.44 inches and about 2.56 inches along a width thereof located adjacent the inner

32 of such pair of front wall portions 34 and 36 and a thickness of about 0.94 inch and about 1.06 inch along a width thereof located adjacent the inner surface 22 of the rear wall portion 14.

Each of the front wall portions 34 and 36 will preferably have a thickness of generally between about 0.85 inch and about 0.91 inch.

According to the presently preferred method of manufacturing, the rear draft stop and bolster spacer apparatus 10, each of the rear wall portion 14 and the pair of side wall portions 16 and 18 and the top wall portion 26 including the first cavity and the bottom wall portion 44 including the second cavity and the pair of front wall portions 34 and 36 will all be cast as an integral single piece unit. It is even more preferred that in addition to those items described above, the other wall portion 48 including the third cavity will also be cast as a integral single piece unit and in the most preferred embodiment the rib-like portion 28 will also be cast simultaneously.

While a number of presently preferred and alternative embodiments of the improved railway car combination rear draft stop and bolster spacer plate apparatus have been described in detail above, it should be obvious to those persons who are skilled in the railway equipment art that various other modifications and adaptations of such apparatus can be made without departing from the spirit and scope of the appended claims.

I claim:

1. An improved railway car combination rear draft stop and bolster spacer plate apparatus which can be cast as an integral single piece unit for mounting within a generally hollow center sill member of such railway car, said combination rear draft stop and bolster spacer plate apparatus comprising:

(a) a generally rectangular shaped rear wall portion having a first predetermined width and a first predetermined height and a first predetermined thickness;

(b) a pair of generally rectangular shaped side wall portions having a first predetermined configuration and a second predetermined width and a second predetermined height, a rear edge portion of each of said pair of side wall portions is joined with a respective outer edge portion of said rear wall portion along said first predetermined height of said rear wall portion and said second predetermined height of said rear edge portion of said each of said pair of side wall portions, an outer surface of said each of said pair of side wall portions being disposed substantially at right angles to an outer surface of said rear wall portion;

(c) a generally rectangular shaped top wall portion formed adjacent an upper edge portion of each of said rear wall portion and said each of said pair of side wall portions, said top wall portion having a first predetermined length and a third predetermined width and a second predetermined thickness;

(d) a first cavity formed through said top wall portion having a second predetermined configuration, said first cavity starting adjacent a front outer edge of said top wall portion and extending rearwardly toward an inner surface of said rear wall portion for a first predetermined distance;

(e) a generally rectangular shaped bottom wall portion formed adjacent a bottom edge portion of said rear wall portion and said each of said pair of side wall portions, said bottom wall portion having a second predetermined length and a fourth predetermined width and a third predetermined thickness;

(f) a second cavity formed through said bottom wall portion having a third predetermined configuration, said second cavity starting adjacent a front outer edge of said bottom wall portion and extending rearwardly toward said inner surface of said rear wall portion for a second predetermined distance; and (g) a pair of generally rectangular shaped front wall portions having a substantially flat outer surface thereof engageable by at least a portion of a rear surface of a back wall of a draft gear, said front wall portions limiting rearward movement of such draft gear during a buff load being exerted thereon, each of said front wall portions extending inwardly from an inner surface of a respective side wall portion for a third predetermined distance and between a bottom surface of said top wall portion and an upper surface of said bottom wall portion.

2. An improved railway car combination rear draft stop and bolster spacer plate apparatus, according to claim 1, wherein said apparatus further includes another wall portion, having a third predetermined length and a fifth predetermined width, disposed intermediate said bottom surface of said top wall portion and said upper surface of said bottom wall portion, said another wall portion including a third cavity formed therethrough having a fourth predetermined configuration, said third cavity starting adjacent a front outer edge of said another wall portion and extending rearwardly toward said inner surface of said rear wall portion for a third predetermined distance.

3. An improved railway car combination rear draft stop and bolster spacer plate apparatus, according to claim 2, wherein said apparatus further includes a rib-like portion having a fifth predetermined configuration extending above an outer surface of a top edge portion of each of said rear wall portion and said pair of side wall portions, said rib-like portion providing a welding surface to assist in securing said apparatus within such hollow center sill member of such railway car.

4. An improved railway car combination rear draft stop and bolster spacer plate apparatus, according to claim 3, wherein said apparatus further includes a groove-like portion formed in a bottom surface of said bottom wall portion, said groove-like portion extending from said outer surface of a first of said pair of side wall portions to said outer surface of a second of said pair of side wall portions, one edge of said groove-like portion being disposed behind a vertical plane extending along an inner surface of said pair of front wall portions and a second axially-opposed edge of said groove-like portion being disposed in front of a vertical plane extending along said inner surface of said rear wall portion.

5. An improved railway car combination rear draft stop and bolster spacer plate apparatus, according to claim 2, wherein said fourth predetermined configuration of said another wall portion includes a thickness of between about 2.44 inches and about 2.56 inches along a width thereof adjacent said inner surface of said pair of front wall portions and a thickness of about 0.94 inch and about 1.06 inch along a width thereof adjacent said inner surface of said rear wall portion.

6. An improved railway car combination rear draft stop and bolster spacer plate apparatus, according to claim 5, wherein said second predetermined configuration of said first cavity and said third predetermined configuration of said second cavity and said fourth predetermined configuration of said third cavity are substantially identical.

7. An improved railway car combination rear draft stop and bolster spacer plate apparatus, according to claim 6, wherein said second predetermined configuration of said first cavity and said third predetermined configuration of said second cavity and said fourth predetermined configuration of said third cavity are bulb-shaped.

8. An improved railway car combination rear draft stop and bolster spacer plate apparatus, according to claim 2, wherein each of said rear wall portion and said pair of side wall portions and said top wall portion and said first cavity and said bottom wall portion and said second cavity and said pair of front wall portions and said another wall portion and said third cavity are all cast as an integral piece unit.

9. An improved railway car combination rear draft stop and bolster spacer plate apparatus, according to claim 3, wherein each of said rear wall portion and said pair of side wall portions and said top wall portion and said first cavity and said bottom wall portion and said second cavity and said pair of front wall portions and said another wall portion and said third cavity and said rib-like portion are all cast as an integral single piece unit.

10. An improved railway car combination rear draft stop and bolster spacer plate apparatus, according to claim 1, wherein said rear wall portion includes at least one aperture formed therethrough, said at least one aperture providing reduced weight of said apparatus.

11. An improved railway car combination rear draft stop and bolster spacer plate apparatus, according to claim 10, wherein said rear wall portion includes at least two apertures formed therethrough to provide a maximum reduction in weight of said apparatus, a first of said apertures being disposed between said top wall portion and said another wall portion and a second of said apertures being disposed between said bottom wall portion and said another wall portion of said apparatus.

12. An improved railway car combination rear draft stop and bolster spacer plate apparatus, according to claim 11, wherein each of said apertures has a length dimension greater than a width dimension.

13. An improved railway car combination rear draft stop and bolster spacer plate apparatus, according to claim 12, wherein each end of said apertures has a generally rounded shape.

14. An improved railway car combination rear draft stop and bolster spacer plate apparatus, according to claim 1, wherein said first predetermined configuration of said each of said pair of side wall portions includes a thickened wall section extending from an inner surface of a respective one of said pair of front wall portions and merging into said inner surface at a predetermined location on a respective one of said pair of side wall portions.

15. An improved railway car combination rear draft stop and bolster spacer plate apparatus, according to claim 14, wherein said thickened wall section is generally triangular shaped.

16. An improved railway car combination rear draft stop and bolster spacer plate apparatus, according to claim 1, wherein said first predetermined width of said rear wall portion is between about 12.81 inches and about 12.87 inches.

17. An improved railway car combination rear draft stop and bolster spacer plate apparatus, according to claim 16, wherein said first predetermined thickness of said rear wall portion is between about 0.615 inch and about 0.645 inch.

18. An improved railway car combination rear draft stop and bolster spacer plate apparatus, according to claim 17, wherein said second predetermined width of said pair of side wall portions is between about 10.63 inches and about 10.72 inches.

19. An improved railway car combination rear draft stop and bolster spacer plate apparatus, according to claim 18, wherein a thickness of each of said pair of front wall portions is generally between about 0.85 inch and about 0.91 inch.

20. An improved railway car combination rear draft stop and bolster spacer plate apparatus, according to claim 1, wherein each of said rear wall portion and said pair of side wall portions and said top wall portion and said first cavity and said bottom wall portion and said second cavity and said pair of front wall portions are all cast as an integral single piece unit.

* * * * *

UNITED STATES PATENT AND TRADEMARK OFFICE

CERTIFICATE OF CORRECTION

PATENT NO. : 5, 135,117

DATED : August 4, 1992

INVENTOR(S) : Charles A. Geis

It is certified that error appears in the above-identified patent and that said Letters Patent is hereby corrected as shown below:

Column 4, line 12, delete "!";

line 16, delete "or" and insert --of--;

line 58, after "the", second occurrence, insert --top--;

line 64, delete "27";

line 65, after "cavity" insert --27--.

Column 6, line 20, delete "!4" and insert --14--;

line 37, after "inner", insert --surface--.

Column 8, line 26, delete "5" and insert --11--;

line 35, delete "6" and insert --12--;

line 37, delete "5" and insert --11--;

line 42, delete "7" and insert --13--;

line 44, delete "6" and insert --12--;

line 49, delete "8" and insert --19--;

line 57, delete "9" and insert --20--;

line 66, delete "10" and insert --5--.

Column 9, line 3, delete "11" and insert --6--;

line 5, delete "10" and insert --5--;

UNITED STATES PATENT AND TRADEMARK OFFICE

CERTIFICATE OF CORRECTION

PATENT NO. : 5,135,117

DATED : August 4, 1992

INVENTOR(S) : Charles A. Geis

It is certified that error appears in the above-identified patent and that said Letters Patent is hereby corrected as shown below:

Column 9, line 12, delete "12" and insert --7--;

line 14, delete "11" and insert --6--;

line 16, delete "13" and insert --8--;

line 18, delete "12" and insert --7--;

line 20, delete "14" and insert --9--;

line 29, delete "15" and insert --10--;

Column 10, line 1, delete "14" and insert --9--;

line 3, delete "16" and insert --14--;

UNITED STATES PATENT AND TRADEMARK OFFICE

CERTIFICATE OF CORRECTION

PATENT NO. : 5,135,117

DATED : August 4, 1992

INVENTOR(S) : Charles A. Geis

It is certified that error appears in the above-identified patent and that said Letters Patent is hereby corrected as shown below:

Column 10, line 8, delete "17" and insert --15--;

line 10, delete "16" and insert --14--;

line 13, delete "18" and insert --16--;

line 15, delete "17" and insert --15--;

line 18, delete "19" and insert --17--;

line 20, delete "18" and insert --16--;

line 23, delete "20" and insert --18--;

Signed and Sealed this

Sixteenth Day of November, 1993

*Attest:*

Bruce Lehman

BRUCE LEHMAN

*Attesting Officer*

*Commissioner of Patents and Trademarks*